US007374461B2

(12) United States Patent
van der Steen

(10) Patent No.: US 7,374,461 B2
(45) **Date of Patent: *May 20, 2008**

(54) HIGH SPEED RECEPTACLE CONNECTOR PART

(75) Inventor: Hendrikus Petrus Gijsbertus van der Steen, Den Dungen (NL)

(73) Assignee: FCI SA, Versailles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/627,274

(22) Filed: Jan. 25, 2007

(65) Prior Publication Data

US 2007/0117467 A1 May 24, 2007

Related U.S. Application Data

(63) Continuation of application No. 10/818,814, filed on Apr. 6, 2004, now Pat. No. 7,229,324.

(51) Int. Cl.
*H01R 13/00* (2006.01)

(52) U.S. Cl. ..... 439/682; 439/857

(58) Field of Classification Search ..... 439/857, 439/856, 682, 636, 630

See application file for complete search history.

(56) References Cited

U.S. PATENT DOCUMENTS

| | | | | |
|---|---|---|---|---|
| 2,476,510 | A | 7/1949 | Rosner | 439/265 |
| 3,594,699 | A | 7/1971 | Jayne | 339/75 |
| 3,646,500 | A | 2/1972 | Wesseley | 339/65 |
| 3,671,917 | A | 6/1972 | Ammon et al. | 339/17 |
| 3,737,838 | A | 6/1973 | Mattingly, Jr. et al. | 339/186 |
| 3,865,462 | A | 2/1975 | Cobaugh et al. | 339/176 |
| 4,140,361 | A | 2/1979 | Sochor | 339/258 |
| 4,217,024 | A | 8/1980 | Aldridge et al. | 339/275 |
| 4,420,215 | A | 12/1983 | Tengler | 339/176 |
| 4,591,230 | A | 5/1986 | Roldan | 339/258 |
| 4,752,246 | A | 6/1988 | Triner et al. | 439/682 |
| 4,772,396 | A | 9/1988 | Voyt | 210/605 |
| 5,009,618 | A | 4/1991 | Black et al. | 439/736 |
| 5,137,462 | A | 8/1992 | Casey et al. | 439/74 |
| 5,162,002 | A | 11/1992 | Regnier | 439/637 |
| 5,334,053 | A | 8/1994 | Noschese | 439/682 |
| 5,389,010 | A | 2/1995 | Takano et al. | 439/565 |
| 5,399,108 | A | 3/1995 | Lu et al. | 439/682 |

(Continued)

FOREIGN PATENT DOCUMENTS

EP 0 977 319 A2 2/2000

(Continued)

*Primary Examiner*—Truc T. Nguyen
*Assistant Examiner*—Xuong Chung-Trans
(74) *Attorney, Agent, or Firm*—Woodcock Washburn LLP

(57) ABSTRACT

A receptacle connector part comprises a connector housing and a plurality of rows of receptacle contact terminals disposed within the housing. Each receptacle contact terminal includes two single beam contacts having contact portions with a preloading head. The connector housing comprises a front wall with a plurality of rows of apertures providing access to the contact portions of the contact terminals. The connector housing is provided with a plurality of rows of preload ridges, the preload ridges being located at the inner side of the front wall at opposed sides of the apertures. The preload ridges cooperate with the preloading heads to support the contact portions of the single beam contacts of each contact terminal in a predetermined preload position.

20 Claims, 9 Drawing Sheets

U.S. PATENT DOCUMENTS

| | | | | |
|---|---|---|---|---|
| 5,475,922 | A | 12/1995 | Tamura et al. | 29/881 |
| 5,551,883 | A | 9/1996 | Davis | 439/65 |
| 5,569,053 | A | 10/1996 | Nelson et al. | 439/668 |
| 5,609,502 | A | 3/1997 | Thumma | 439/747 |
| 5,672,084 | A | 9/1997 | Feldman | 439/852 |
| 5,675,582 | A | 10/1997 | Hummel et al. | 370/255 |
| 5,679,018 | A | 10/1997 | Lopata et al. | 439/260 |
| 5,704,800 | A | 1/1998 | Sato et al. | 439/342 |
| 5,719,977 | A | 2/1998 | Lampert et al. | 385/60 |
| 6,019,521 | A | 2/2000 | Manning et al. | 385/77 |
| 6,050,836 | A | 4/2000 | Tohyama | 439/266 |
| 6,080,001 | A | 6/2000 | Wong | 439/344 |
| 6,149,315 | A | 11/2000 | Stephenson | 385/60 |
| 6,254,278 | B1 | 7/2001 | Andrews et al. | 385/53 |
| 6,264,490 | B1 | 7/2001 | Lemke et al. | 439/342 |
| 6,345,999 | B1 | 2/2002 | Okuyama et al. | 439/268 |
| 6,371,772 | B1 | 4/2002 | Yoneyama et al. | 439/79 |
| 6,595,791 | B2 | 7/2003 | Below et al. | 439/271 |
| 6,652,318 | B1 | 11/2003 | Winings et al. | 439/608 |
| 2001/0036762 | A1 | 11/2001 | Payson et al. | 439/320 |
| 2001/0049229 | A1 | 12/2001 | Pape et al. | 439/608 |
| 2002/0076949 | A1 | 6/2002 | Tilbury et al. | 439/97 |

FOREIGN PATENT DOCUMENTS

| | | |
|---|---|---|
| EP | 1 174 885 A2 | 1/2002 |
| FR | 2 527 388 | 11/1983 |
| GB | 295 765 | 8/1928 |

HIGH SPEED RECEPTACLE CONNECTOR PART

CROSS-REFERENCE TO RELATED APPLICATIONS

This application is a continuation of U.S. patent application Ser. No. 10/818,814 filed Apr. 6, 2004, now U.S. Pat. No. 7,229,324, the contents of which are incorporated herein by reference.

FIELD OF THE INVENTION

The invention relates in general to electrical connectors. More particularly, the invention relates to a high speed receptacle connector part.

BACKGROUND OF THE INVENTION

As the speed of electronics increases, electrical connectors are desired that are capable of high speed communications. Electrical connectors provide signal connections between electronic devices using signal contacts. With electronic device miniaturization and high speed electronic communications becoming more prevalent, the signal contacts will be very closely spaced. Often, the signal contacts are so closely spaced that signal integrity becomes a problem.

One method for improving signal integrity is removing the plastic material in the contact area of the contacts. In this manner air will be the main dielectric in the contact area of the contacts. However reducing plastic material in the contact area of a connector part poses problems regarding positioning and supporting of the contact portions of the signal contacts. Therefore, a need exists for a high speed electrical connector design that reduces the plastic material while maintaining a guaranteed support of the contact portions of the signal contacts.

SUMMARY OF THE INVENTION

The invention satisfies the aforementioned need by providing a high speed receptacle connector part, wherein all plastic material in the contact area of the contact terminals has been removed. According to an aspect of the invention a receptacle connector part is provided, comprising a connector housing and a plurality of rows of receptacle contact terminals disposed within the housing. Each receptacle contact terminal includes two single beam contacts having contact portions with a preload head, and the connector housing comprises a front wall with a plurality of rows of apertures providing access to the contact portions of the contact terminals. Specifically, the connector housing is provided with a plurality of rows of preload ridges, the preload ridges being located at the inner side of the front wall at opposed sides of the apertures, wherein the preload ridges cooperate with said preload heads to support the contact portions of the single beam contacts of each contact terminal in a predetermined preload position.

BRIEF DESCRIPTION OF THE DRAWINGS

The invention will be further explained by reference to the drawings showing an illustrative embodiment of the receptacle connector part according to the invention.

DETAILED DESCRIPTION OF ILLUSTRATIVE EMBODIMENTS

Figure 1:
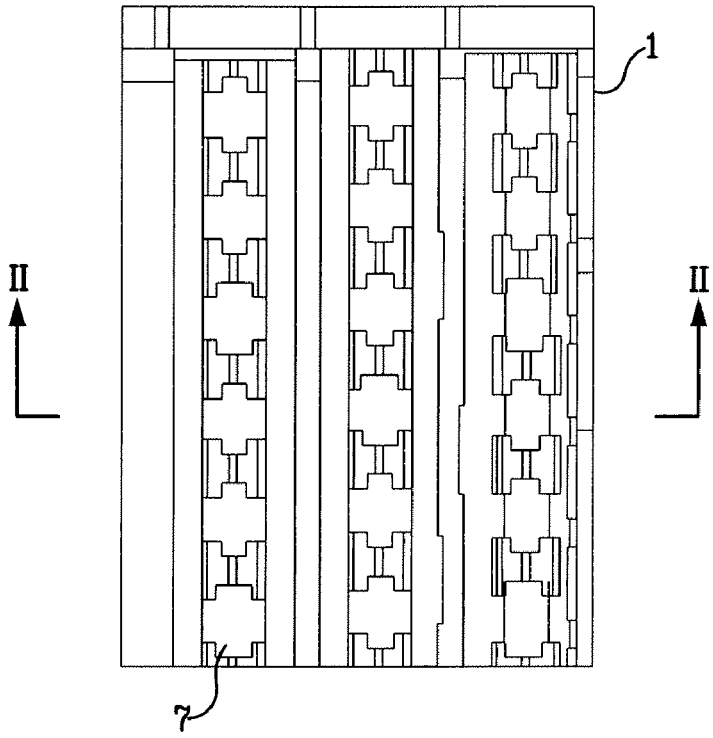
FIG. 1 is a top view of the back side of the connector housing of an exemplary embodiment of the receptacle connector part in accordance with the invention.
Figure 2:
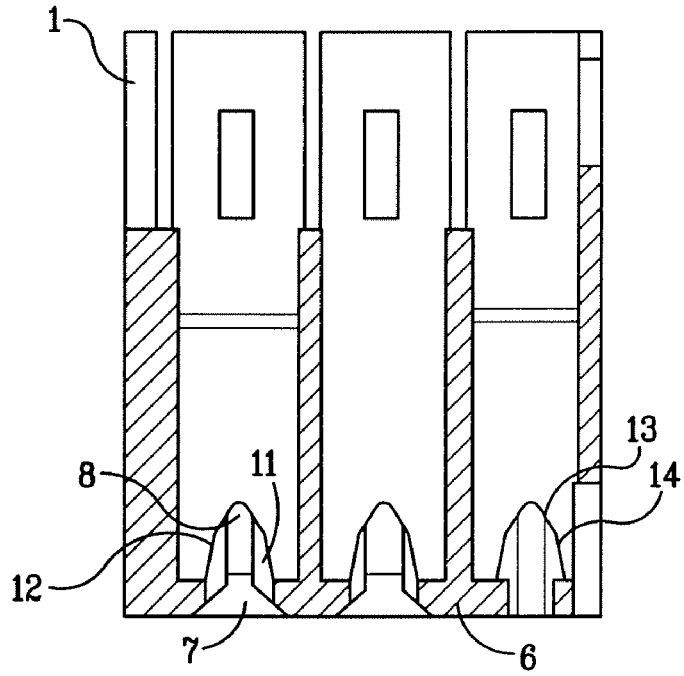
FIG. 2 is a cross-section of the connector housing according to the line II-II in FIG. 1.
Figure 3:
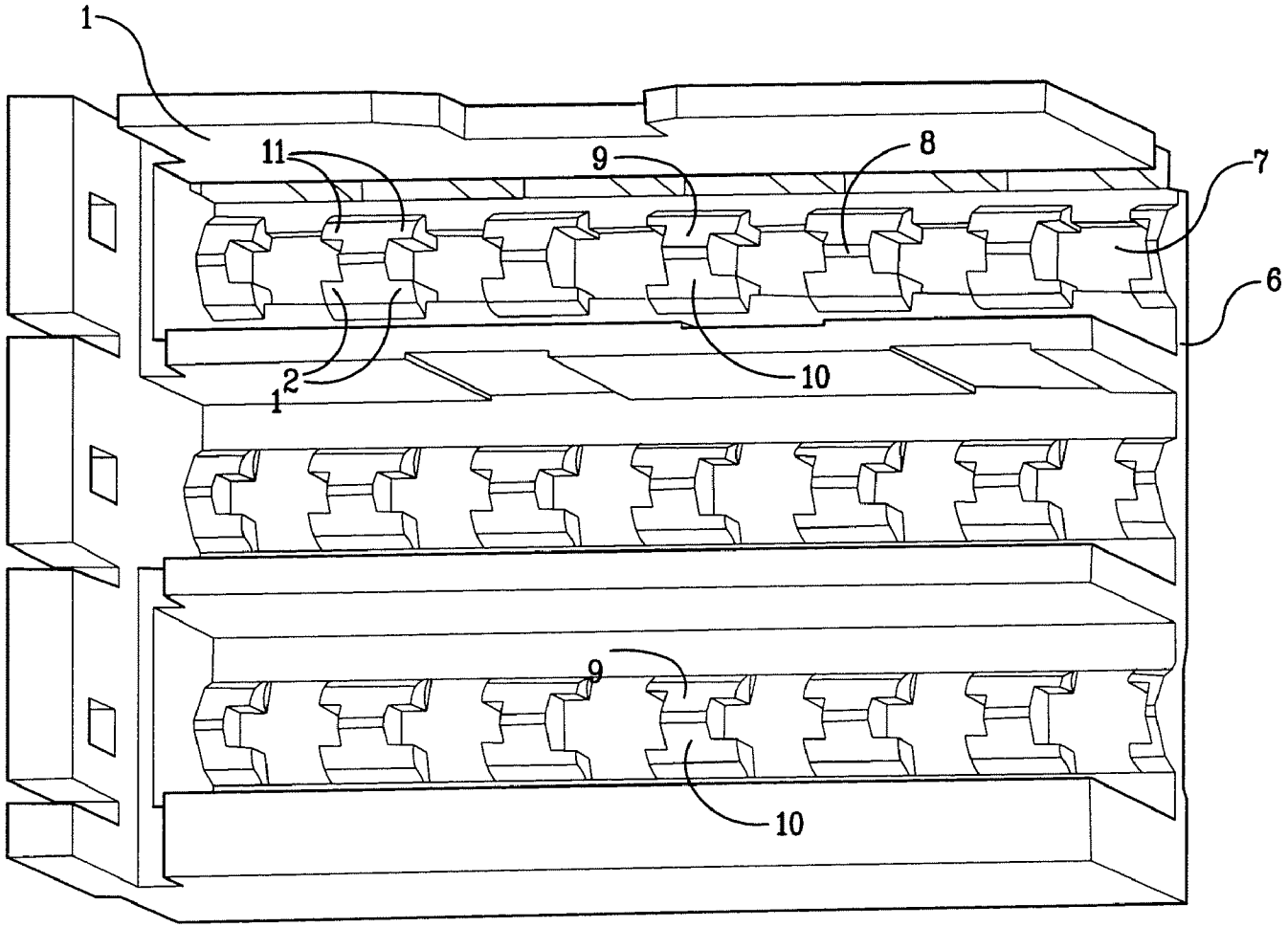
FIG. 3 is a perspective view of the connector housing of FIG. 1.
Figure 4B:
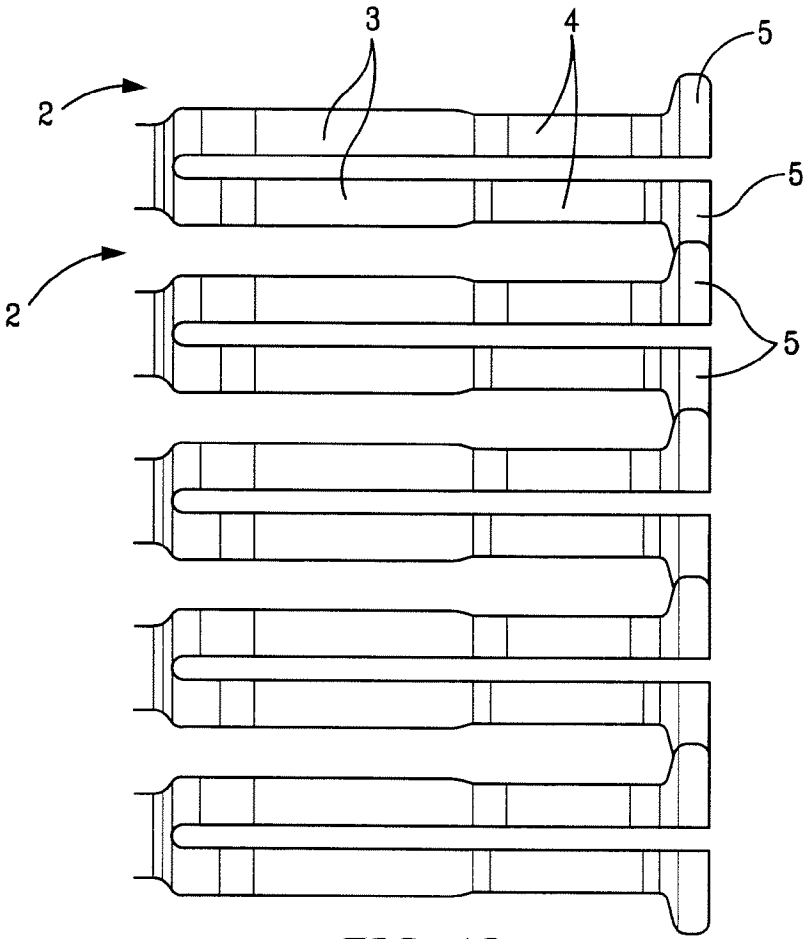
FIGS. 4A and 4B show a top and side views of a row of receptacle contact terminals to be mounted in the connector housing of FIG. 1.
Figure 4A:
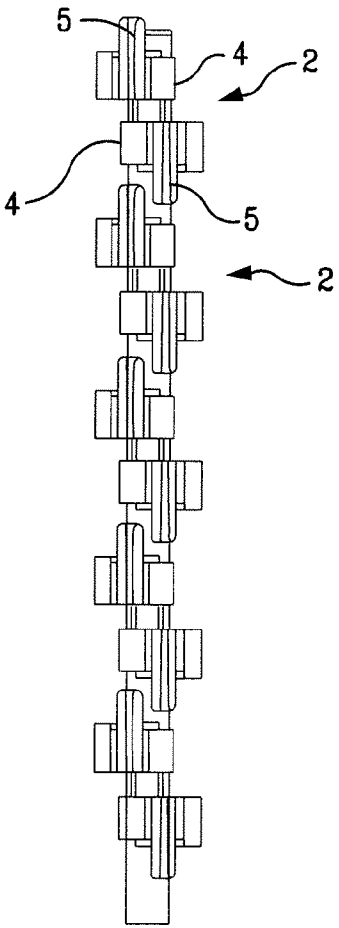
Figure 5:
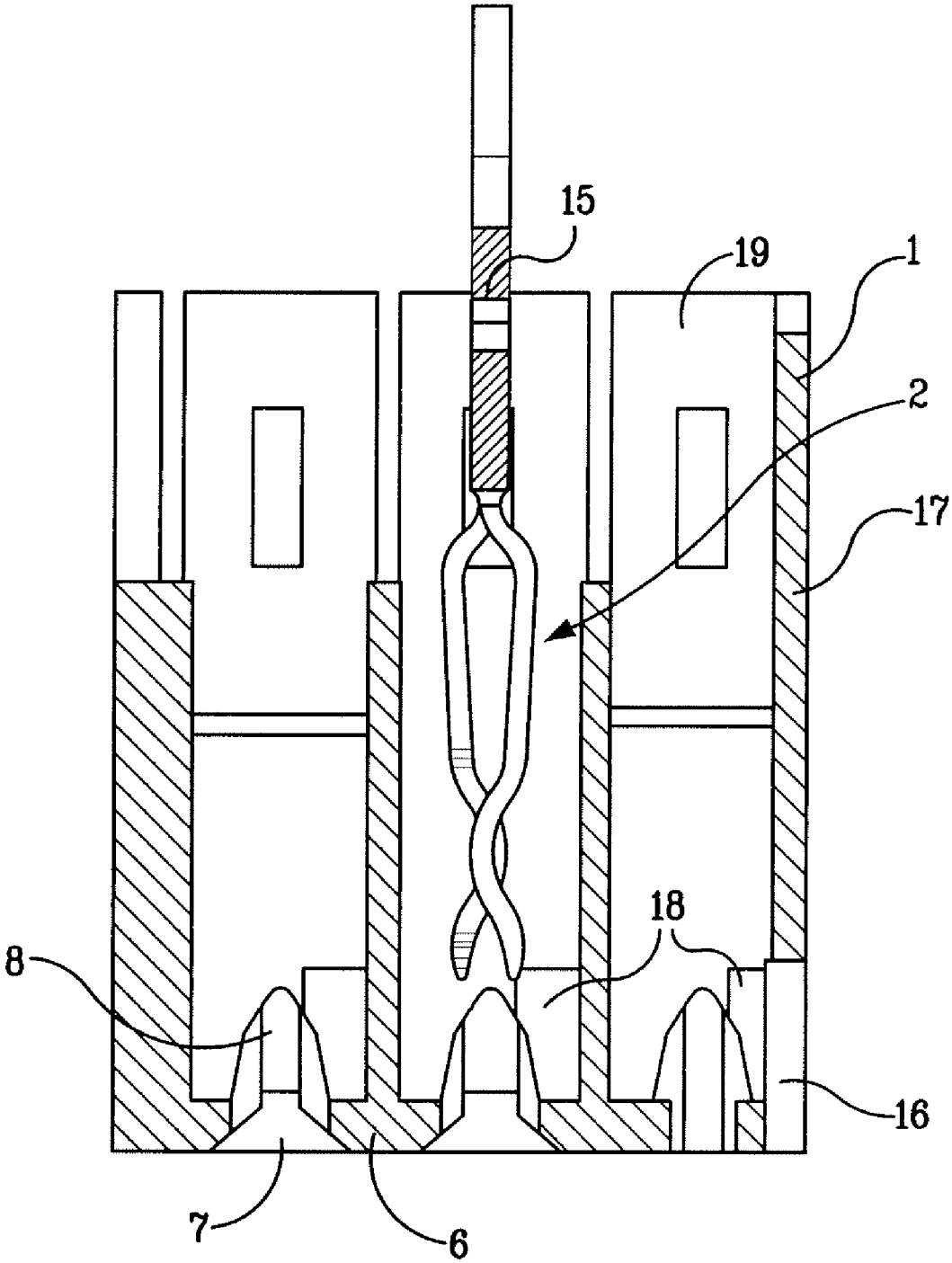
FIG. 5 shows a cross-section of the connector housing of FIG. 1 during the assembly step of inserting a row of receptacle contact terminals.
Figure 6:
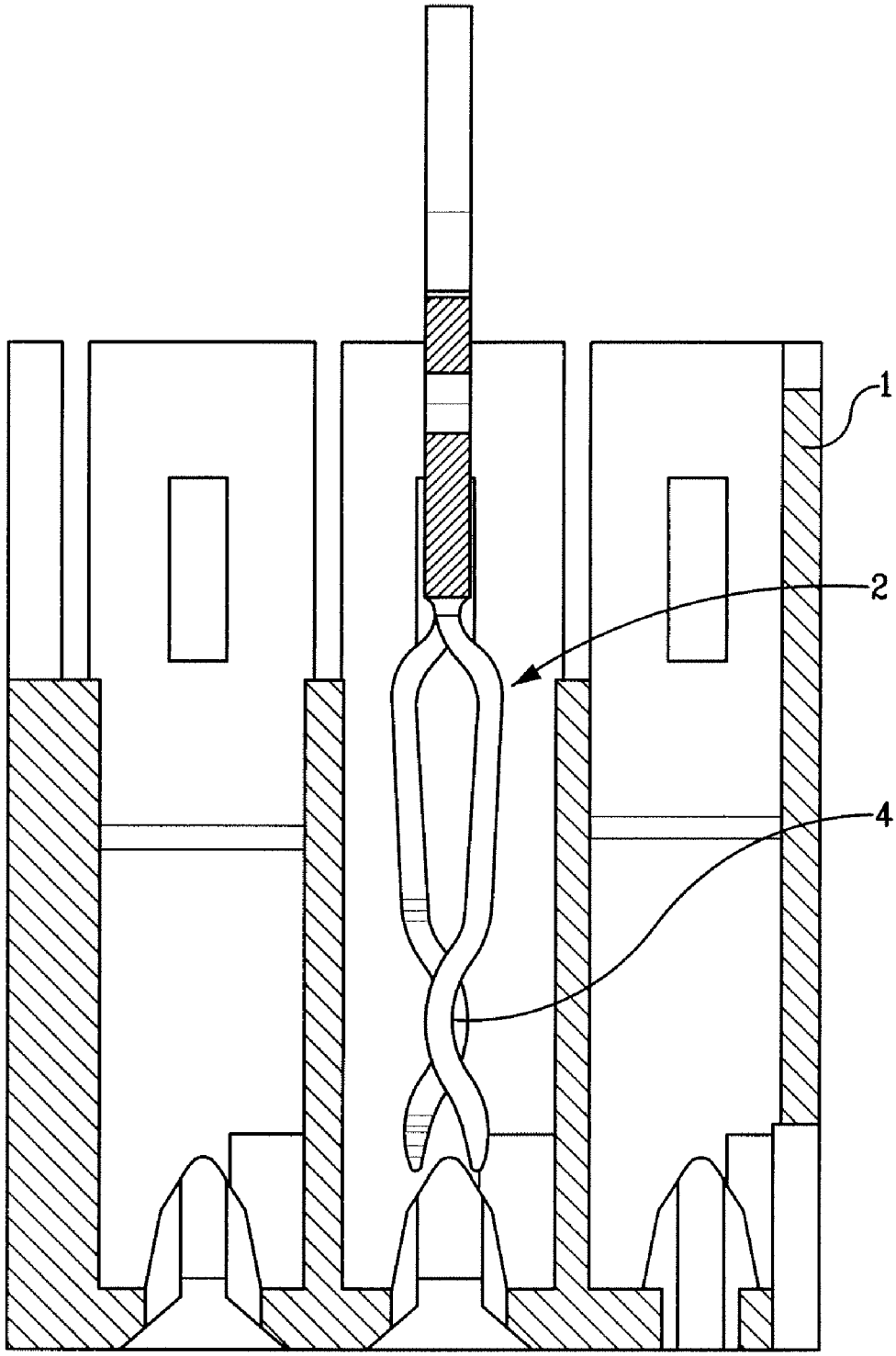
FIG. 6 shows a cross-section corresponding to FIG. 5, wherein the contact portion of the receptacle contact terminals is meeting the preload ridges.
Figure 7:
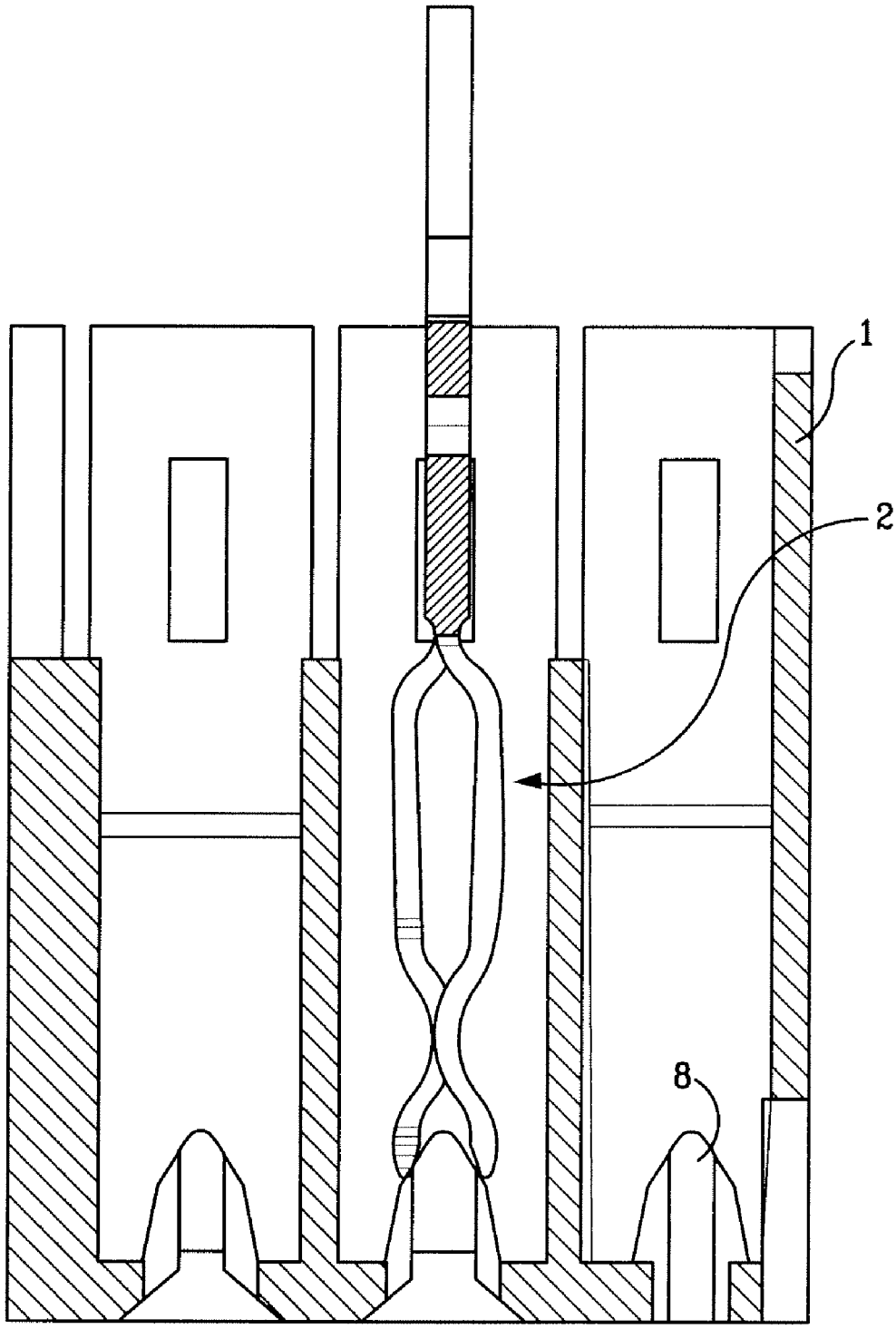
FIG. 7 shows a cross-section corresponding to FIG. 5, wherein the row of receptacle contact terminals is further inserted into the housing.

Referring to the drawings there is shown an embodiment of the receptacle connector part according to the invention, comprising a connector housing 1 shown in FIGS. 1-3, and a plurality of rows of receptacle contact terminals 2 shown in FIGS. 4A and 4B. FIGS. 5-8 show a cross section of the connector housing 1 with one row of contact terminals 2 during an assembly step of inserting the contact terminals 2 into the housing 1. In the drawings the connector housing 1 is shown open at one side for explanation purposes only. Normally, a side wall will be present.

Each receptacle contact terminal 2 includes two single beam contacts 3 having a contact portion 4 with a preload head 5 at its contact tip. As can be seen in the side view of the row of contact terminals 2 in FIG. 4B the contact portions have a kind of hammer head shape, wherein the preload heads 5 of the single beam contacts of one contact terminal 2 extend in opposite directions along the row direction.

Figure 8:
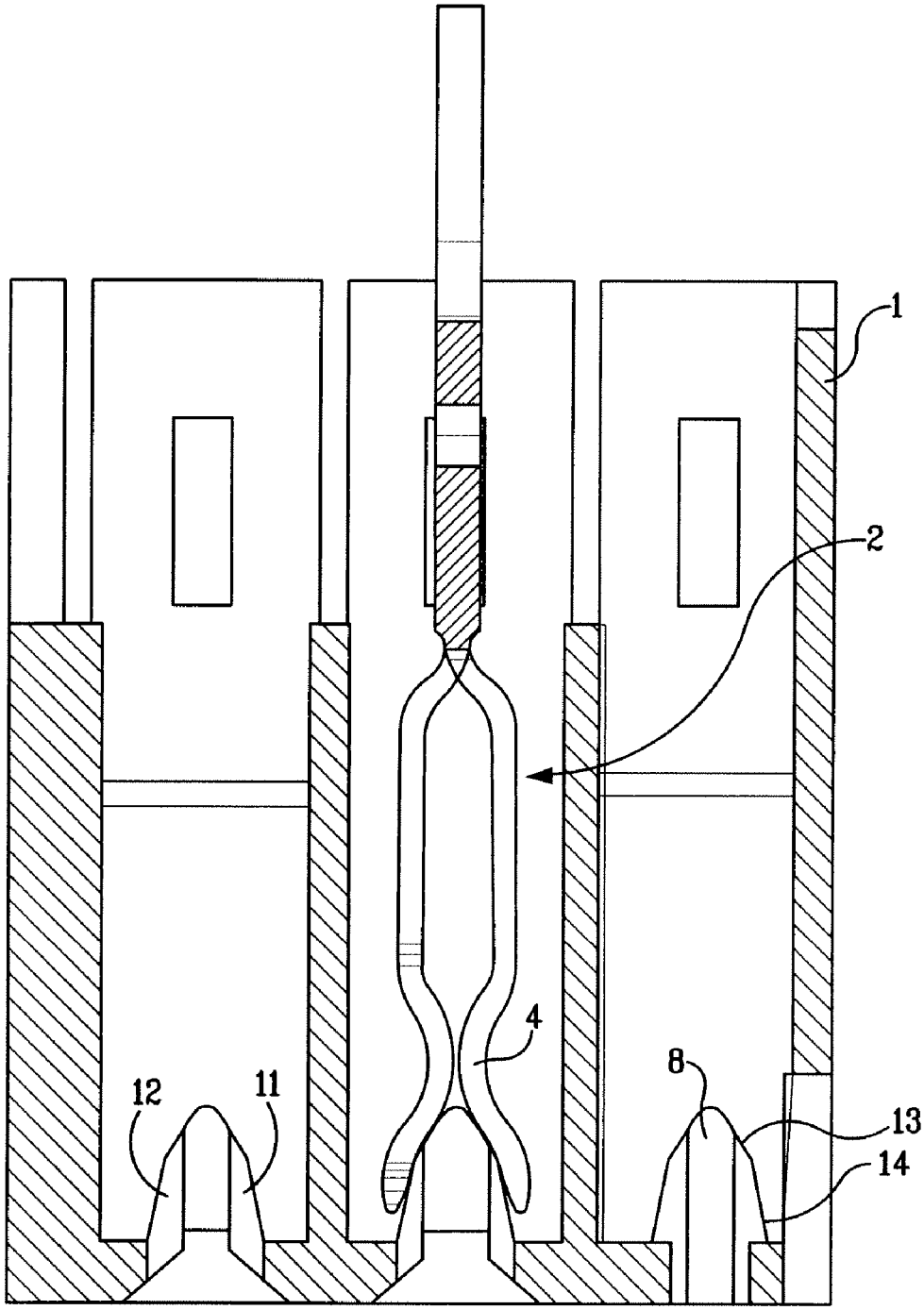
FIG. 8 shows a cross-section corresponding to FIG. 5, wherein the row of receptacle contact terminals is fully inserted into the connector housing.

The connector housing 1 comprises a front wall 6 with a plurality of rows of apertures 7, which apertures 7 provide access to the contact portions 4 of the contact terminals 2. Further, the connector housing 1 is provided with a plurality of rows of preload ridges 8 located at the inner side of the front wall 6 at opposed sides of the apertures 7. As will be explained hereinafter the preload ridges 8 cooperate with the preload heads 5 to support the contact portions 4 of the single beam contacts 2 of each contact terminal 2 in a predetermined preload position shown in FIG. 8. In the embodiment shown in the drawings one V-shaped preload ridge 8 is located in between each two adjacent apertures 7. The tip of the V-shaped ridges 8 is directed away from the apertures 7. In this manner, each V-shaped ridge 8 shows two ramp surfaces 9 and 10 extending in a lateral and downward direction from the centre line of a row of apertures 7 to one side of the row of apertures. It is noted that lateral direction means transverse to the row direction and downwards means from the upper to the lower side of the views as shown in FIGS. 2 and 8.

Although in the embodiment shown one V-shaped preload ridge 8 is located in between each two adjacent apertures 7, it will be clear that different embodiments and shapes of pre-load ridges are possible providing ramp surfaces 9, 10 extending in the same manner in a lateral and downward direction. For example, separated V-shaped ridges could be provided, each having ramp surfaces 9, 10. Such V-shaped ridges 8 can be seen at the upper and lower sides of the top view of FIG. 1. As a further alternative separated preload ridges could be provided, one preload ridge having the ramp surface 9 and the other preload ridge having the ramp surface 10. In the latter case the ramp surfaces 9, 10 could extend along the full transverse dimension of the apertures 7.

Preferably, the V-shaped preload ridges 8 are provided with four support extensions 11, 12, each two support extensions 11, 12 extending in row direction along opposed sides in an aperture 7. In this manner, each aperture 7 is bounded by four support extensions 11, 12 directed towards each other at opposed sides of the aperture.

In the embodiment shown in the drawings, the ramp surfaces 9, 10 of the V-shaped preload ridges have first and second sections 13, 14, extending downwardly at different angles. As can be seen in the cross-sections of FIGS. 2 and 8, for example, the second section 14 extends more steeply downwardly as the first section 13.

Figure 9:
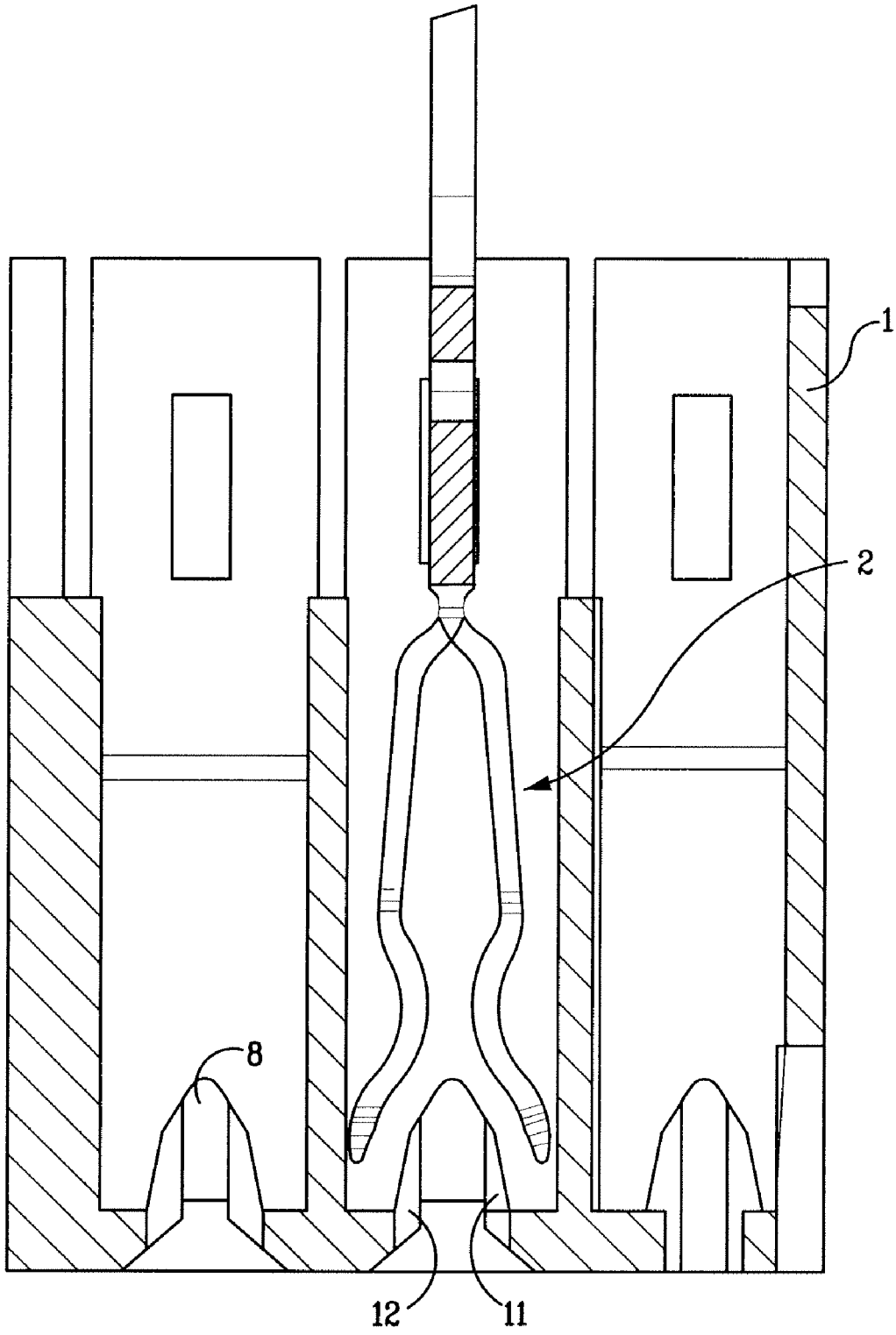
FIG. 9 shows a cross-section corresponding to FIG. 8, wherein the contact portions of the contact terminals are shown in a position as if a plug signal or ground contact has been inserted.

FIGS. 5-8 show subsequent phases of the assembly of the receptacle connector part as described, during which assembly the rows of contact terminals 2 are inserted into the connector housing 1. In the cross-section of FIG. 5 a centre row of contact terminals 2 is in a first phase of the insertion process. It is noted that a row of contact terminals can be provided as an assembly as described in U.S. Pat. No. 6,652,318, wherein the terminals are interconnected by a holder 15 of insulating material. The contact portions 4 are slightly open at the contact tip, so that the tip of the V-shaped ridges 8 can be received in between the contact portions 4. In the cross-section of FIG. 6, the preload heads 5 of the contact portions 4 are meeting with the first sections 13 of the ramp surfaces 9, 10 of the V-shapes ridges 8 at both sides of the corresponding apertures 7. During the further insertion of the row of contact terminals 2 into the connector housing 1, the contact portions 4 are further opened as the preload heads 5 move further downwards along the ramp surfaces 9, 10. In the last part of the insertion process, the preload heads 5 of the contact portions 4 will be received on the support extensions 11 of the V-shaped ridges 8 as shown in particular in FIG. 8. FIG. 9 shows a cross section of the connector housing 1 as in FIG. 8, wherein the contact portions 4 are moved outwardly as if a contact pin has been inserted through the corresponding aperture 7. In this contacting position the preload heads 5 are lifted off from the support extensions 11, 12.

In the final position of the contact terminals 2 as shown in FIG. 8, the contact portions 4 are accurately supported with a guaranteed preload, wherein the contact area of the contact portions 4 is fully free of any plastic material. In this manner the signal integrity performance of the contact terminals 2 is improved. Moreover, the design of the V-shaped preload ridges 8 with the support extensions 11, 12 extending along the sides of the apertures 7 in row direction, guarantees a reliable support of the contact portions 4 in the pre-load position within the full range of manufacturing tolerances of all parts of the receptacle connector part.

Figure 10:
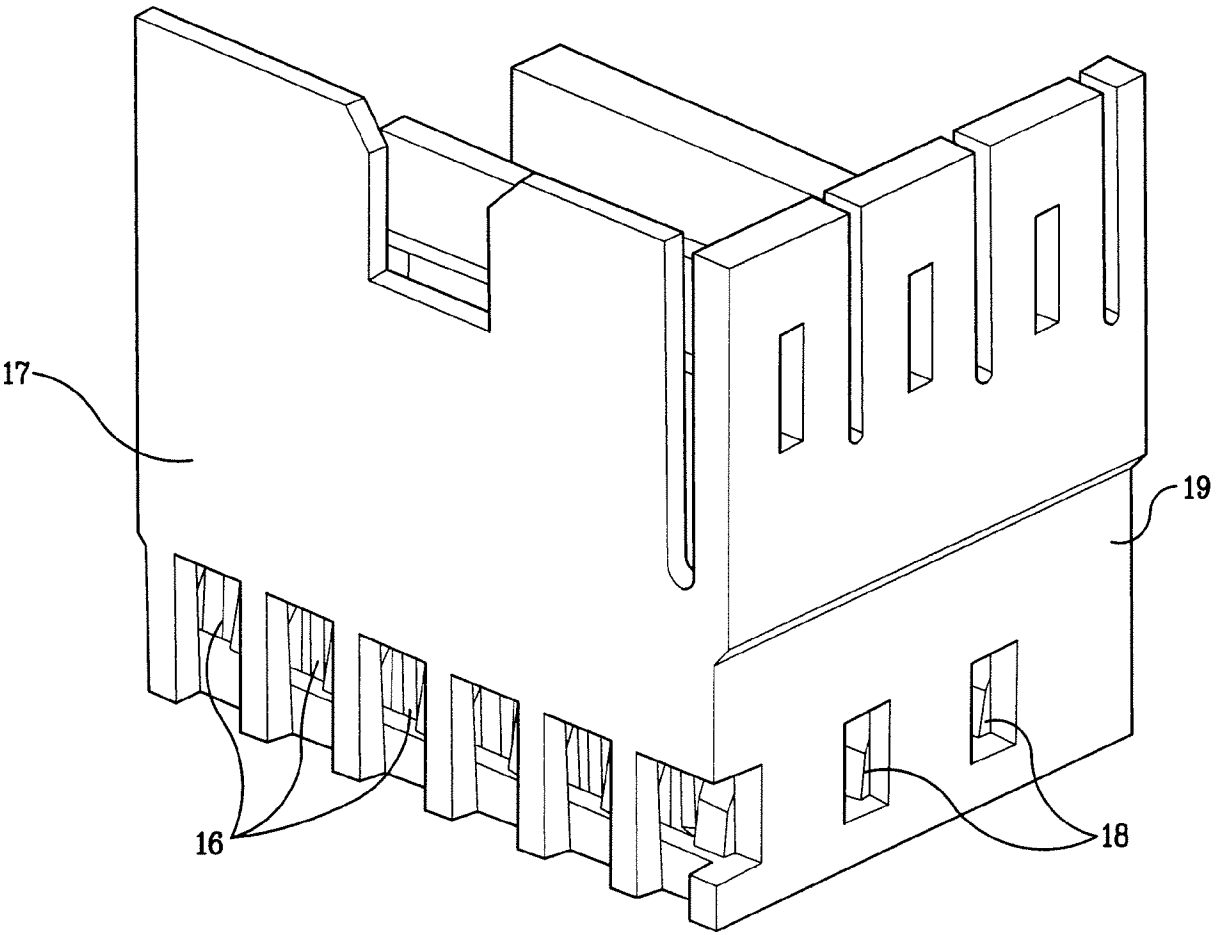
FIG. 10 is a perspective view of the connector housing.

In the embodiment of the receptacle connector part shown, any interference of the contact portions, in particular the contact tip parts thereof, is avoided by providing windows 16 in the sidewall 17 of the connector housing 1. These windows 16 receive the contact portion of the terminals 2 of the adjacent row of receptacle contact terminals. In the same manner windows 18 are provided in the lateral sidewalls 19 of the connector housing 1, only one of which is shown in the drawings. FIG. 10 illustrates the presence of the windows 16 in the sidewall 17 and the windows 18 in the lateral sidewall 19.

It is to be understood that the foregoing illustrative embodiments have been provided merely for the purpose of explanation and are in no way to be construed as limiting of the invention. The invention extends to all functionally equivalent structures, such as are within the scope of the appended claims.

What is claimed:

1. An electrical connector comprising:

a base housing;

a housing cover assembled onto the base housing, said housing cover defining an inner wall, first and second preload ridges extending from the inner wall, and an aperture between said first and second preload ridges, wherein each said preload ridge defines a respective first section extending at a first angle relative to the inner wall, and a respective second section adjacent to the first section that extends at a second angle relative to the inner wall, wherein the second angle is different from the first angle; and a receptacle contact extending into the base housing, said receptacle contact having a pair of contact beams that engage the preload ridges such that the aperture is disposed between the contact beams, wherein the contact beams define a respective first portion and a respective second portion, and wherein the respective first section of said preload ridges contacts the respective first portion of the contact beams at the first angle and the respective second section of said preload ridges contacts the respective second portion of the contact beams at the second angle.

2. The electrical connector of claim 1, wherein the first and second sections cause the contact beams to move apart to preload the contact beams against the preload ridges.

3. The electrical connector of claim 1, wherein said aperture is for receiving a complementary electrical contact into the receptacle contact.

4. The electrical connector of claim 1, wherein the second section is farther from the inner wall than the first section and the second angle is less than the first angle.

5. The electrical connector of claim 1, wherein the contact is a bifurcated dual-beam contact.

6. The electrical connector of claim 1, wherein the contact comprises a pair of single beams.

7. The electrical connector of claim 1, wherein each of the base housing and the cover is molded from an electrically insulating material.

8. The electrical connector of claim 1, wherein the contact is stamped from a sheet of electrically conductive material.

9. The electrical connector of claim 1, wherein the contact is retained in the base housing.

10. The electrical connector of claim 1, wherein the first preload ridge causes a first of the pair of contact beams to move in a first direction as the first preload ridge engages the first contact beam.

11. The electrical connector of claim 10, wherein the second preload ridge causes a second of the pair of contact beams to move in a direction opposite the first direction as the second preload ridge engages the second contact beam.

12. The electrical connector of claim 11, wherein the second contact beam moves in the direction opposite the first direction by a predetermined distance in response to movement of the cover toward the base housing.

13. The electrical connector of claim 11, wherein the first and second sections of the first preload ridge oppose, respectively, the first and second sections of the second preload ridge.

14. The electrical connector of claim 1, further comprising a second receptacle contact extending into the base housing, said second receptacle contact having a contact beam that engages the first preload ridge.

15. The electrical connector of claim 14, further comprising a third receptacle contact extending into the base housing, said third receptacle contact having a contact beam that engages the second preload ridge.

16. An electrical connector comprising:

a base housing;

a receptacle contact extending into the base housing, said receptacle contact having a pair of contact beams, each said contact beam having a lead-in surface that defines a first portion and a second portion for engaging a respective preload ridge defined by a housing cover, said housing cover defining an inner wall from which the preload ridges extend and an aperture between the preload ridges, wherein each said preload ridge defines a first section extending at a first angle relative to the inner wall, and a second section adjacent to the first section that extends at a second angle relative to the inner wall, wherein the second angle is different from the first angle, wherein each said contact beam is adapted to move by a predetermined distance to preload the contact beam against the preload ridge such that the aperture is disposed between the contact beams, and wherein, at the predetermined distance, the first section of the preload ridges contacts the first portion of the lead-in surface at the first angle and the second section of the preload ridges contacts the second portion of the lead-in surface at the second angle.

17. The electrical connector of claim 16, wherein each contact beam is adapted to cam outwardly relative to the aperture in response to motion of the cover toward the base.

18. The electrical connector of claim 16, further comprising a second receptacle contact extending into the base housing, said second receptacle contact having a contact beam that engages at least one of the preload ridges.

19. An electrical connector comprising:

a base housing;

a housing cover assembled onto the base housing; and an electrical contact inserted into the base housing, said electrical contact having a contact beam with a lead-in surface that defines a first portion and a second portion for engaging a preload ridge defined by the housing cover, said housing cover defining an inner wall from which the preload ridge extends and an aperture proximate the preload ridge, wherein said preload ridge defines a first section extending at a first angle relative to the inner wall, and a second section adjacent to the first section that extends at a second angle relative to the inner wall, wherein the second angle is different from the first angle, wherein the contact beam is adapted to move a specified distance to preload the contact beam against the preload ridge, and wherein, at the specified distance, the first section of the preload ridge contacts the first portion of the lead-in surface at the first angle and the second section of the preload ridge contacts the second portion of the lead-in surface at the second angle.

20. The electrical connector of claim 19, wherein the receptacle contact has a second contact beam with a lead-in surface for engaging a second preload ridge defined by the housing cover, said housing cover further defining an aperture disposed between the first and second preload ridges for receiving a complementary electrical contact between the beams of the receptacle contact.

* * * * *